United States Patent [19]

Secrest et al.

[11] Patent Number: 4,731,846

[45] Date of Patent: Mar. 15, 1988

[54] VOICE MESSAGING SYSTEM WITH PITCH TRACKING BASED ON ADAPTIVELY FILTERED LPC RESIDUAL SIGNAL

[75] Inventors: Bruce G. Secrest; George R. Doddington, both of Richardson, Tex.

[73] Assignee: Texas Instruments Incorporated, Dallas, Tex.

[21] Appl. No.: 484,711

[22] Filed: Apr. 13, 1983

[51] Int. Cl.[4] ..... G10L 5/00

[52] U.S. Cl. ..... 381/49

[58] Field of Search ..... 381/29, 30, 31, 32, 381/33, 34, 35, 36, 37, 38, 39, 40, 41, 42, 43, 44, 45, 46, 47, 48, 49, 50, 51; 364/513, 513.5

[56] References Cited

U.S. PATENT DOCUMENTS

| | | | |
|---|---|---|---|
| 3,975,587 | 8/1976 | Dunn et al. | 381/49 |
| 3,979,557 | 9/1976 | Schulman et al. | 381/49 |
| 4,044,204 | 8/1977 | Wolnowsky et al. | 381/49 |
| 4,220,819 | 9/1980 | Atal | 381/40 |
| 4,360,708 | 11/1982 | Taguchi et al. | 381/36 |
| 4,472,832 | 9/1984 | Atal et al. | 381/40 |
| 4,516,259 | 5/1985 | Yato et al. | 381/36 |
| 4,561,102 | 12/1985 | Prezas | 381/49 |

OTHER PUBLICATIONS

"A Linear Prediction Vocoder Simulation Based upon the Autocorrelation Method"—Markel et al., *IEEE Transactions on Acoustics, Speech, and Signal Processing,* vol. ASSP-22, No. 6, pp. 124–134 (Apr. 1974).

"A Pitch Extraction Algorithm Based on LPC Inverse Filtering and AMDF"—Un et al., *IEEE Transactions on Acoustics, Speech, and Signal Processing,* vol. ASSP-25, No. 6, pp. 565–572 (Dec. 1977).

"Epoch Extraction from Linear Prediction Residual for Identification of CLosed Glottis Interval"—Ananthapadmanabha et al., *IEEE Transactions on Acoustics, Speech, and Signal Processing,* vol. ASSP-27, No. 4, pp. 309–319 (Aug. 1979).

*Primary Examiner*—Emanuel S. Kemeny

*Attorney, Agent, or Firm*—William E. Hiller; N. Rhys Merrett; Melvin Sharp

[57] ABSTRACT

A voice messaging system, wherein linear predictive coding (LPC) parameters, pitch, and preferably other excitation information is derived from a human voice input, encoded, and transmitted and/or stored, to be called up later to provide a speech output which is nearly identical to the original speech input. The invention features adaptive filtering of the residual signal. The residual signal derived from LPC estimation is adaptively filtered, and then is used as the input to a conventional pitch estimation procedure. The adaptive filtering step uses the first reflection coefficient ($k_1$) to realize a simple filter (e.g., $A(z)=(1-k_1 z^{-1})^{-1}$. This filter removes high frequency noise from the residual signal during voiced periods, but does not remove the high frequency energy which contains important information during the unvoiced periods of speech. Preferably the above preprocessing technique is also combined with a postprocessing technique, wherein dynamic programming is used to optimally track pitch and voicing information through successive frames.

20 Claims, 6 Drawing Figures

VOICE MESSAGING SYSTEM WITH PITCH TRACKING BASED ON ADAPTIVELY FILTERED LPC RESIDUAL SIGNAL

BACKGROUND AND SUMMARY OF THE INVENTION

The present invention relates to voice messaging systems, wherein pitch and LPC parameters (and usually other excitation information too) are encoded for transmission and/or storage, and are decoded to provide a close replication of the original speech input.

The present invention also relates to speech recognition and encoding systems, and to any other system wherein it is necessary to estimate the pitch of the human voice.

The present invention is particularly related to linear predictive coding (LPC) systems for (and methods of) analyzing or encoding human speech signals. In LPC modeling generally, each sample in a series of samples is modeled (in the simplified model) as a linear combination of preceding samples, plus an excitation function:

$$S_k = \sum_{j=1}^{N} a_j S_{k-j} + u_k \tag{1}$$

where $u_k$ is the LPC residual signal. That is, $u_k$ represents the residual information in the input speech signal which is not predicted by the LPC model. Note that only N prior signals are used for prediction. The model order (typically around 10) can be increased to give better prediction, but some information will always remain in the residual signal $u_k$ for any normal speech modelling application.

Within the general framework of LPC modeling, many particular implementations of voice analysis can be selected. In many of these, it is necessary to determine the pitch of the input speech signal. That is, in addition to the formant frequencies, which in effect correspond to resonances of the vocal tract, the human voice also contains a pitch, modulated by the speaker, which corresponds to the frequency at which the larynx modulates the airstream. That is, the human voice can be considered as an excitation function applied to an acoustic passive filter, and the excitation function will generally appear in the LPC residual function, while the characteristics of the passive acoustic filter (i.e., the resonance characteristics of mouth, nasal cavity, chest, etc.) will be modeled by the LPC parameters. It should be noted that during unvoiced speech, the excitation function does not have a well-defined pitch, but instead is best modeled as broad band white noise or pink noise.

Estimation of the pitch period is not completely trivial. Among the problems is the fact that the first formant will often occur at a frequency close to that of the pitch. For this reason, pitch estimation is often performed on the LPC residual signal, since the LPC estimation process in effect deconvolves vocal tract resonances from the excitation information, so that the residual signal contains relatively less of the vocal tract resonances (formants) and relatively more of the excitation information (pitch). However, such residual-based pitch estimation techniques have their own difficulties. The LPC model itself will normally introduce high frequency noise into the residual signal, and portions of this high frequency noise may have a higher spectral density than the actual pitch which should be detected. One prior art solution to this difficulty is simply to low pass filter the residual signal at around 1000 Hz. This removes the high frequency noise, but also removes the legitimate high frequency energy which is present in the unvoiced regions of speech, and renders the residual signal virtually useless for voicing decisions.

A cardinal criterion in voice messaging applications is the quality of speech reproduced. Prior art systems have had many difficulties in this respect. In particular, many of these difficulties relate to problems of accurately detecting the pitch and voicing of the input speech signal.

It is typically very easy to incorrectly estimate a pitch period at twice or half its value. For example, if correlation methods are used, a good correlation at a period P guarantees a good correlation at period 2P, and also means that the signal is more likely to show a good correlation at period P/2. However, such doubling and halving errors produce very annoying degradation in voice quality. For example, erroneous halving of the pitch period will tend to produce a squeaky voice, and erroneous doubling of the pitch period will tend to produce a coarse voice. Moreover, pitch period doubling or halving is very likely to occur intermittently, so that the synthesized voice will tend to crack or to grate, intermittently.

Thus, it is an object of the present invention to provide a voice messaging system wherein errors of pitch period doubling and halving are avoided.

It is a further object of the present invention to provide a voice messaging system wherein voices are not reproduced with erroneous squeaky, cracking, coarse, or grating qualities.

A related difficulty in prior art voice messaging systems is voicing errors. If a section of voiced speech is incorrectly determined to be unvoiced, the reproduced speech will sound as through it was whispered rather than spoken speech. If a section of unvoiced speech is incorrectly estimated to be voiced, the regenerated speech in this section will show a buzzing quality.

Thus, it is an object of the present invention to provide a voice messaging system, wherein voicing errors are avoided.

It is a further object of the present invention to provide a voice messaging system wherein spurious buzz and dropouts do not appear in the reconstituted speech.

The pitch usually varies fairly smoothly across frames. In the prior art, tracking of pitch across frames has been attempted, but the interrelation of the pitch and voicing decisions can pose difficulties. That is, where the voicing decision is made separately, the voicing and pitch decisions must still be reconciled. Thus, this method poses a heavy processor load.

It is a further object of the invention to provide a voice messaging system wherein pitch is tracked consistently with respect to plural frames in the sequence of frames, without imposing a heavy processor load.

It is a further object of the present invention to provide a voice messaging system wherein voicing decisions are made consistently across a sequence of frames.

It is a further object of the present invention to provide a voice messaging system wherein pitch and voicing decisions are made consistently across a sequence of frames, without imposing a heavy processor load.

The present invention uses an adaptive filter to filter the residual signal. By using a time-varying filter which has a single pole at the first reflection coefficient ($k_1$ of the speech input), the high frequency noise is removed from the voiced periods of speech, but the high frequency information in the unvoiced speech periods is retained. The adaptively filtered residual signal is then used as the input for the pitch decision.

It is necessary to retain the high frequency information in the unvoiced speech periods to permit better voicing/unvoicing decisions. That is, the "unvoiced" voicing decision is normally made when no strong pitch is found, that is when no correlation lag of the residual signal provides a high normalized correlation value. However, if only a low-pass filtered portion of the residual signal during unvoiced speech periods is tested, this partial segment of the residual signal may have spurious correlations. That is, the danger is that the truncated residual signal which is produced by the fixed low-pass filter of the prior art does not contain enough data to reliably show that no correlation exists during unvoiced periods, and the additional band width provided by the high-frequency energy of unvoiced periods is necessary to reliably exclude the spurious correlation lags which might otherwise be found.

Thus, it is an object of the present invention to provide a method for filtering high-frequency noise out during voiced speech periods, without making erroneous voicing decisions during unvoiced speech periods.

It is a further object of the invention to provide a voice messaging system which does not make erroneous high-frequency pitch assignments during voiced speech periods, and which also does not make erroneous voicing decisions during unvoiced speech periods.

It is a further object of the present invention to provide a system for making pitch and voicing estimates of speech which disregards high-frequency noise during voiced speech segments and which uses high-frequency information during unvoiced speech segments.

Improvement in pitch and voicing decisions is particularly critical for voice messaging systems, but is also desirable for other applications. For example, a word recognizer which incorporated pitch information would naturally require a good pitch estimation procedure. Similarly, pitch information is sometimes used for speaker verification, particularly over a phone line, where the high frequency information is partially lost. Moreover, for long-range future recognition systems, it would be desirable to be able to take account of the syntactic information which is denoted by pitch. Similarly, a good analysis of voicing would be desirable for some advanced speech recognition systems, e.g., speech to text systems.

Thus, it is a further object of the present invention to provide a method for making optimal pitch decisions in a series of frames of input speech.

It is a further object of the present invention to provide a method for making optimal voicing decisions in a sequence of frames of input speech.

It is a further object of the present invention to provide a method for making optimal speech and voicing decisions in a sequence of frames of input speech.

The first reflection coefficient $k_1$ is approximately related to the high/low frequency energy ratio and a signal. See. R. J. McAulay, "Design of a Robust Maximum Likelihood Pitch Estimator for Speech and Additive Noise," Technical Note, 1979-28, Lincoln Labs, June 11, 1979, which is hereby incorporated by reference. For $k_1$ close to $-1$, there is more low frequency energy in the signal than high-frequency energy, and vice versa for $k_1$ close to 1. Thus, by using $k_1$ to determine the pole of a 1-pole deemphasis filter, the residual signal is low pass filtered in the voiced speech periods and is high pass filtered in the unvoiced speech periods. This means that the formant frequencies are excluded from computation of pitch during the voiced periods, while the necessary high-band width information is retained in the unvoiced periods for accurate detection of the fact that no pitch correlation exists.

Preferably a post-processing dynamic programming technique is used to provide not only an optimal pitch value but also an optimal voicing decision. That is, both pitch and voicing are tracked from frame to frame, and a cumulative penalty for a sequence of frame pitch-/voicing decisions is accumulated for various tracks to find the track which gives optimal pitch and voicing decisions. The cumulative penalty is obtained by imposing a frame error in going from one frame to the next. The frame error preferably not only penalizes large deviations in pitch period from frame to frame, but also penalizes pitch hypotheses which have a relatively poor correlation "goodness" value, and also penalizes changes in the voicing decision if the spectrum is relatively unchanged from frame to frame. This last feature of the frame transition error therefore forces voicing transitions towards the points of maximal spectral change.

According to the present invention there is provided:

A voice messaging system, for encoding and regenerating human speech, comprising:

means for receiving an analog input speech signal;

LPC analysis means, connected to said input means for analyzing said input speech signal according to an LPC (linear predictive coding) model, said LPC analysis means providing LPC parameters and a residual signal;

an adaptive filter connected to receive said residual signal and at least one of said LPC parameters from said LPC analysis means, said adaptive filter filtering said residual signal according to a filter characteristic defined by at least one of said LPC parameters;

means operatively connected to said filter for extracting pitch and voicing information from said filtered residual signal; and means for encoding said pitch and voicing information and said LPC parameters.

BRIEF DESCRIPTION OF THE DRAWINGS

The present invention will be described with reference to the accompanying drawings, wherein.

DESCRIPTION OF THE PREFERRED EMBODIMENTS

Figure 1:
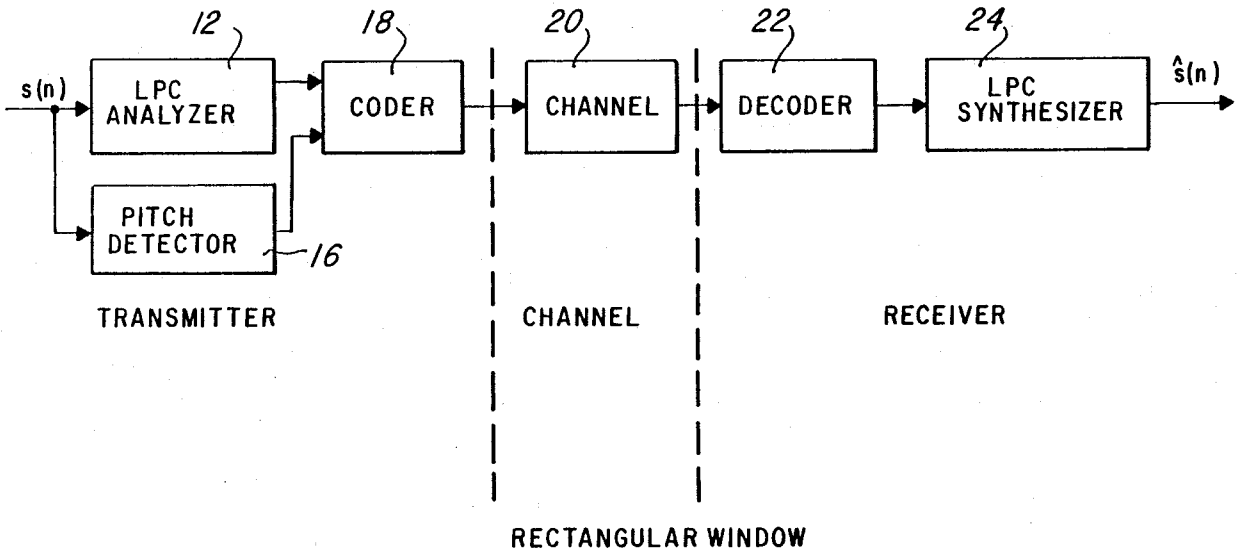
FIG. 1 shows the configuration of a voice messaging system generally.
Figure 2:
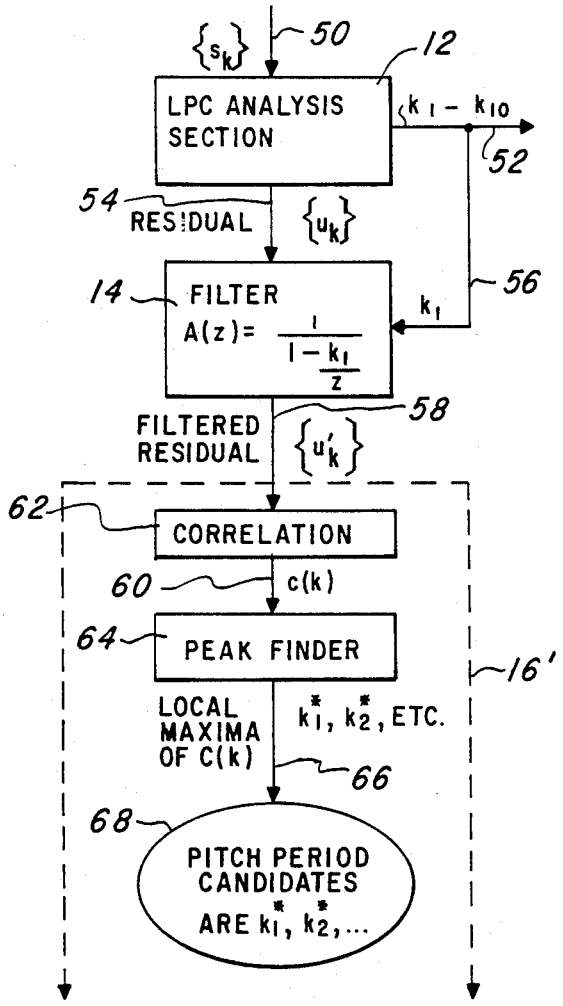
FIG. 2 shows generally the configuration of the portion of the system of the present invention wherein improved selection of a set of pitch period candidates is achieved.

FIG. 2 shows generally the configuration of the system of the present invention, whereby improved selection of pitch period candidates and voicing decisions is achieved. A speech input signal, which is shown as a time series $s_i$, is provided to an LPC analysis block. The LPC analysis can be done by a wide variety of conventional techniques, but the end product is a set of LPC parameters and residual signal $u_i$. Background on LPC analysis generally, and on various methods for extraction of LPC parameters, is found in numerous generally known references, includng Markel and Gray, *Linear Prediction of Speech* (1976) and Rabiner and Schafer, *Digital Processing of Speech Signals* (1978), and references cited therein, all of which are hereby incorporated by reference.

In the presently preferred embodiment, the analog speech waveform is sampled at a frequency of 8 KHz and with a precision of 16 bits to produce the input time series $s_1$. Of course, the present invention is not dependent at all on the sampling rate or the precision used, and is applicable to speech sampled at any rate, or with any degree of precision, whatsoever.

In the presently preferred embodiment, the set of LPC parameters which is used includes a plurality of reflection coefficients $k_i$, and a 10th-order LPC model is used (that is, only the reflection coefficients $k_1$ through $k_{10}$ are extracted, and higher order coefficients are not extracted). However, other model orders or other equivalent sets of LPC parameters can be used, as is well known to those skilled in the art. For example, the LPC predictor coefficients $a_k$ can be used, or the impulse response estimates $e_k$. However, the reflection coefficients $k_i$ are most convenient.

In the presently preferred embodiment, the reflection coefficients are extracted according to the Leroux-Gueguen procedure, which is set forth, for example, in IEEE Transactions on Acoustics, Speech and Signal Processing, p. 257 (June 1977), which is hereby incorporated by reference. However, other algorithms well known to those skilled in the art, such as Vurbin's, could be used to compute the coefficients.

A by-product of the computation of the LPC parameters will typically be a residual signal $u_k$. However, if the parameters are computed by a method which does not automatically pop out the $u_k$ as a by-product, the residual can be found simply by using the LPC parameters to configure a finite-impulse-response digital filter which directly computes the residual series $u_k$ from the input series $s_k$.

The residual signal time series $u_k$ is not put through a very simple digital filtering operation, which is dependent on the LPC parameters for the current frame. That is, the speech input signal $s_k$ is a time series having a value which can change once every sample, at a sampling rate of, e.g., 8 Khz. However, the LPC parameters are normally recomputed only once each frame period, at a frame frequency of, e.g., 100 Hz. The residual signal $u_k$ also has a period equal to the sampling period. Thus, the digital filter 14, whose value is dependent on the LPC parameters, is preferably not readjusted at every residual signal $u_k$. In the presently preferred embodiment, approximately 80 values in the residual signal time series $u_k$ pass through the filter 14 before a new value of the LPC parameters is generated, and therefore a new characteristic for the filter 14 is implemented.

More specifically, the first reflection coefficient $k_1$ is extracted from the set of LPC parameters provided by the LPC analysis section 12. Where the LPC parameters themselves are the reflection coefficients $k_I$, it is merely necessary to look up the first reflection coefficient $k_1$. However, where other LPC parameters are used, the transformation of the parameters to produce the first order reflection coefficient is typically extremely simple, for example, $$k_1 = a_1/a_0 \tag{2}$$

Although the present invention preferably uses the first reflection coefficient to define a 1-pole adaptive filter, the invention is not as narrow as the scope of this principal preferred embodiment. That is, the filter need not be a single-pole filter, but may be configured as a more complex filter, having one more poles and or one or more zeros, some or all of which may be adaptively varied according to the present invention.

It should also be noted that the adaptive filter characteristic need not be determined by the first reflection coefficient $k_1$. As is well known in the art, there are numerous equivalent sets of LPC parameters, and the parameters in other LPC parameter sets may also provide desirable filtering characteristics. Particularly, in any set of LPC parameters, the lowest order parameters are most likely to provide information about gross spectral shape. Thus, an adaptive filter according to the present invention could use $a_1$ or $e_1$ to define a pole, can be a single or multiple pole and can be used alone or in combination with other zeros and or poles. Moreover, the pole (or zero) which is defined adaptively by an LPC parameter need not exactly coincide with that parameter, as in the presently preferred embodiment, but can be shifted in magnitude or phase.

Thus, the 1-pole adaptive filter 14 filters the residual signal times series $u_k$ to produce a filtered time series $u'_k$. As discussed above, this filtered time series $u'_k$ will have its high frequency energy greatly reduced during the voiced speech segments, but will retain nearly the full frequency band width during the unvoiced speech segments. This filtered residual signal $u'_k$ is then subjected to further processing, to extract the pitch candidates and voicing decision.

A wide variety of methods to extract pitch information from a residual signal exist, and any of them can be used. Many of these are discussed generally in the Markel and Gray book incorporated by reference above.

In the presently preferred embodiment, the candidate pitch values are obtained by finding the peaks in the normalized correlation function of the filtered residual signal, defined as follows:

$$C(k) = \frac{\sum_{j=0}^{M-1} u_j u_{j-k}}{\left(\sum_{j=0}^{M-1} u_j^2\right)^{\frac{1}{2}} \left(\sum_{j=0}^{M-1} u_{j-k}^2\right)^{\frac{1}{2}}} \text{ for } k_{min} \leqq k \leqq k_{max} \tag{3}$$

where $u'_j$ is the filtered residual signal, $k_{min}$ and $k_{max}$ define the boundaries for the correlation lag k, and m is the number of samples in one frame period (80 in the preferred embodiment) and therefore defines the number of samples to be correlated. The candidate pitch values are defined by the lags k* at which the value of C(k*) takes a local maximum, and the scalar value of C(k) is used to define a "goodness" value for each candidate k*.

Optionally a threshold value $C_{min}$ will be imposed on the goodness measure C(k), and local maxima of C(k) which do not exceed the threshold value $C_{min}$ will be ignored. If no k* exists for which C(k*) is greater than $C_{min}$, then the frame is necessarily unvoiced.

Alternately, the goodness threshold $C_{min}$ can be dispensed with, and the normalized autocorrelation function 16' can simply be controlled to report out a given number of candidates which have the best goodness values, e.g., the 16 pitch period candidates k having the largest values of C(k).

In one embodiment, no threshold at all is imposed on the goodness value C(k), and no voicing decision is made at this stage. Instead, the 16 pitch period candidates $k^*_1$, $k^*_2$, etc., are reported out, together with the corresponding goodness value ($C(k^*_i)$) for each one. In the presently preferred embodiment, the voicing decision is not made at this stage, even if all of the C(k) values are extremely low, but the voicing decision will be made in the succeeding dynamic programming step, discussed below.

In the presently preferred embodiment, a variable number of pitch candidates are identified, according to a peak-finding algorithm. That is, the graph of the "goodness" values C(k) versus the candidate pitch period k is tracked. Each local maximum is identified as a possible peak. However, the existence of a peak at this identified local maximum is not confirmed until the function has thereafter dropped by a constant amount. This confirmed local maximum then provides one of the pitch period candidates. After each peak candidate has been identified in this fashion, the algorithm then looks for a valley. That is, each local minimum is identified as a possible valley, but is not confirmed as a valley until the function has thereafter risen by a predetermined constant value. The valleys are not separately reported out, but a confirmed valley is required after a confirmed peak before a new peak will be identified. In the presently preferred embodiment, where the goodness values are defined to be bounded by +1 or −1, the constant value required for confirmation of a peak or for a valley has been set at 0.2, but this can be widely varied. Thus, this stage provides a variable number of pitch candidates as output, from zero up to 15.

In the presently preferred embodiment, the set of pitch period candidates provided by the foregoing steps is then provided to a dynamic programming algorithm. This dynamic programming algorithm tracks both pitch and voicing decisions, to provide a pitch and voicing decision for each frame which is optimal in the context of its neighbors.

Given the candidate pitch values and their goodness values C(k), dynamic programming is now used to obtain an optimum pitch contour which includes an optimum voicing decision for each frame. The dynamic programming requires several frames of speech in a segment of speech to be analyzed before the pitch and voicing for the first frame of the segment can be decided. At each frame of the speech segment, every pitch candidate is compared to the retained pitch candidates from the previous frame. Every retained pitch candidate from the previous frame carries with it a cumulative penalty, and every comparison between each new pitch candidate and any of the retained pitch candidates also has a new distance measure. Thus, for each pitch candidate in the new frame, there is a smallest penalty which represents a best match with one of the retained pitch candidates of the previous frame. When the smallest cumulative penalty has been calculated for each new candidate, the candidate is retained along with its cumulative penalty and a back pointer to the best match in the previous frame. Thus, the back pointers define a trajectory which has a cumulative penalty as listed in the cumulative penalty value of the last frame in the project rate. The optimum trajector for any given frame is obtained by choosing the trajectory with the minimum cumulative penalty. The unvoiced state is defined as a pitch candidate at each frame. The penalty function preferably includes voicing information, so that the voicing decision is a natural outcome of the dynamic programming strategy.

Figure 5:
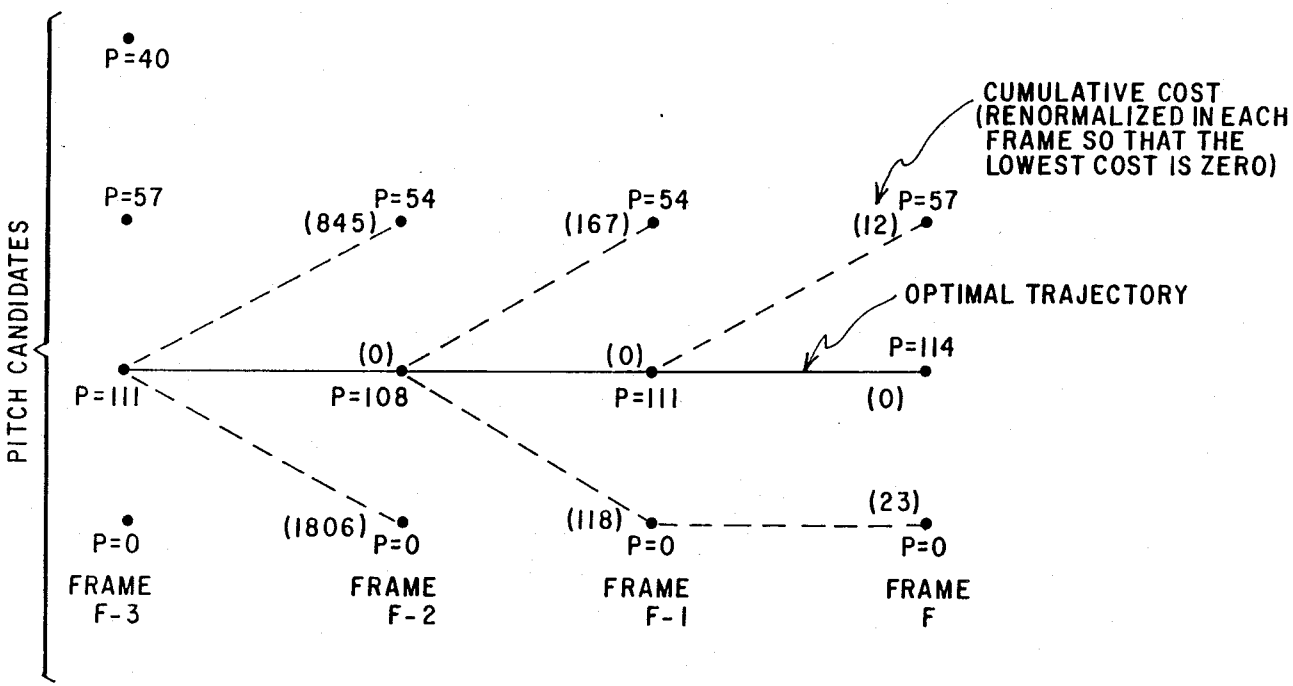
FIG. 5 shows an example of a trajectory in a dynamic programming process, which is used to identify an optimal pitch and voicing decision at a frame prior to the current frame.

In the presently preferred embodiment, the dynamic programming strategy is 16 wide and 6 deep. That is, 15 candidates (or fewer) plus the "unvoiced" decision (stated for convenience as a zero pitch period) are identified as possible pitch periods at each frame, and all 16 candidates, together with their goodness values, are retained for the 6 previous frames. FIG. 5 shows schematically the operation of such a dynamic programming algorithm, indicating the trajectories defined within the data points. For convenience, this diagram has been drawn to show dynamic programming which is only 4 deep and 3 wide, but this embodiment is precisely analogous to the presently preferred embodiment.

The decisions as to pitch and voicing are made final only with respect to the oldest frame contained in the dynamic programming algorithm. That is, the pitch and voicing decision would accept the candidate pitch at frame $F_{K-5}$ whose current trajectory cost was minimal. That is, of the 16 (or fewer) trajectories ending at the most recent frame $F_K$, the candidate pitch in frame $F_K$ which has the lowest cumulative trajectory cost identifies the optimal trajectory. This optimal trajectory is then followed back and used to make the pitch/voicing decision for frame $F_{K-5}$. Note that no final decision is made as to pitch candidates in succeeding frames ($F_{k-4}$, etc.), since the optimal trajectory may no longer appear optimal after more frames are evaluated. Of course, as is well known to those skilled in the art of numerical optimization, a final decision in such a dynamic programming algorithm can alternatively be made at other times, e.g. in the next to last frame held in the buffer. In addition, the width and depth of the buffer can be widely varied. For example, as many as 64 pitch candidates could be evaluated, or as few as two; the buffer could retain as few as one previous frame, or as many as 16 previous frames or more, and other modifications and variations can be instituted as will be recognized by those skilled in the art. The dynamic programming algorithm is defined by the transition error between a pitch period candidate in one frame and another pitch period candidate in the succeeding frame. In the presently preferred embodiment, this transition error is defined as the sum of three parts: an error $E_p$ due to pitch deviations, an error $E_s$ due to pitch candidates having a low "goodness" value, and an error $E_t$ due to the voicing transition.

The pitch deviation error $E_P$ is a function of the current pitch period and the previous pitch period as given by:

$$E_P = \mathrm{MIN}\left\{ A_D + B_P\left|\ln\left(\frac{\tau}{\tau_P}\right)\right|, \quad A_D + B_P\left(\left|\ln\left(\frac{\tau}{\tau_P}\right)\right| + \ln 2\right), \quad A_D + B_P\left(\left|\ln\left(\frac{\tau}{\tau_P}\right)\right| + \ln(\tfrac{1}{2})\right)\right\} \tag{4}$$

if both frames are voiced, and $E_P = B_P \times D_N$ otherwise; where tau is the candidate pitch period of the current frame, $\tau_P$ is a retained pitch period of the previous frame with respect to which the transition error is being computed, and $B_P$, $A_D$, and $D_N$ are constants. Note that the minimum function includes provision for pitch period doubling and pitch period halving. This provision is not strictly necessary in the present invention, but is believed to be advantageous. Of course, optionally, similar provision could be included for pitch period tripling, etc.

The voicing state error, $E_S$, is a function of the "goodness" value C(k) of the current frame pitch candidate being considered. For the unvoiced candidate, which is always included among the 16 or fewer pitch period candidates to be considered for each frame, the goodness value C(k) is set equal to the maximum of C(k) for all of the other 15 pitch period candidates in the same frame. The voicing state error $E_S$ is given by $E_S = B_S(R_V - C(\text{tau})$, if the current candidate is voiced, and $E_S = B_S(C(\text{tau}) - R_U)$ otherwise, where C(tau) is the "goodness value" corresponding to the current pitch candidate tau, and $B_S$, $R_V$, and $R_U$ are constants.

The voicing transition error $E_T$ is defined in terms of a spectral difference measure T. The spectral difference measure T defines, for each frame, generally how different its spectrum is from the spectrum of the receiving frame. Obviously, a number of definitions could be used for such a spectral difference measure, which in the presently preferred embodiment is defined as follows:

$$T = \left(\log\left(\frac{E}{E_P}\right)\right)^2 + \sum_N (L(N) - L_P(N))^2 \tag{5}$$

where E is the RMS energy of the current frame, $E_P$ is the energy of the previous frame, L(N) is the Nth log area ratio of the current frame and $L_P(N)$ is the Nth log area ratio of the previous frame. The log area ratio L(N) is calculated directly from the Nth reflection coefficient $k_N$ as follows:

$$L(N) = \ln\left(\frac{1 - k_N}{1 + k_N}\right) \tag{6}$$

The voicing transition error $E_T$ is then defined, as a function of the spectral difference measure T, as follows:

If the current in previous frames are both unvoiced, or if both are voiced, $E_T$ is set=to 0;

otherwise, $E_T = G_T + A_T/T$, where T is the spectral difference measure of the current frame. Again, the definition of the voicing transition error could be widely varied. The key feature of the voicing transition error as defined here is that, whenever a voicing state change occurs (voiced to unvoiced or unvoiced to voiced) a penalty is assessed which is a decreasing function of the spectral difference between the two frames. That is, a change in the voicing state is disfavored unless a significant spectral change also occurs.

Such a definition of a voicing transition error provides significant advantages in the present invention, since it reduces the processing time required to provide excellent voicing state decisions.

The other errors $E_S$ and $E_P$ which make up the transition error in the presently preferred embodiment can also be variously defined. That is, the voicing state error can be defined in any fashion which generally favors pitch period hypotheses which appear to fit the data in the current frame well over those which fit the data less well. Similarly, the pitch deviation error $E_P$ can be defined in any fashion which corresponds generally to changes in the pitch period. It is not necessary for the pitch deviation error to include provision for doubling and halving, as stated here, although such provision is desirable.

A further optional feature of the invention is that, when the pitch deviation error contains provisions to track pitch across doublings and halvings, it may be desirable to double (or halve) the pitch period values along the optimal trajectory, after the optimal trajectory has been identified, to make them consistent as far as possible.

It should also be noted that it is not necessary to use all of the three identified components of the transition error. For example, the voicing state error could be omitted, if some previous stage screened out pitch hypotheses with a low "goodness" value, or if the pitch periods were rank ordered by "goodness" value in some fashion such that the pitch periods having a higher goodness value would be preferred, or by other means. Similarly, other components can be included in the transition error definition as desired.

It should also be noted that the dynamic programming method taught by the present invention does not necessarily have to be applied to pitch period candidates extracted from an adaptively filtered residual signal, nor even to pitch period candidates which have been derived from the LPC residual signal at all, but can be applied to any set of pitch period candidates, including pitch period candidates extracted directly from the original input speech signal.

These three errors are then summed to provide the total error between some one pitch candidate in the current frame and some one pitch candidate in the preceding frame. As noted above, these transistion errors are then summed cumulatively, to provide cumulative penalties for each trajectory in the dynamic programming algorithm.

Figure 3:
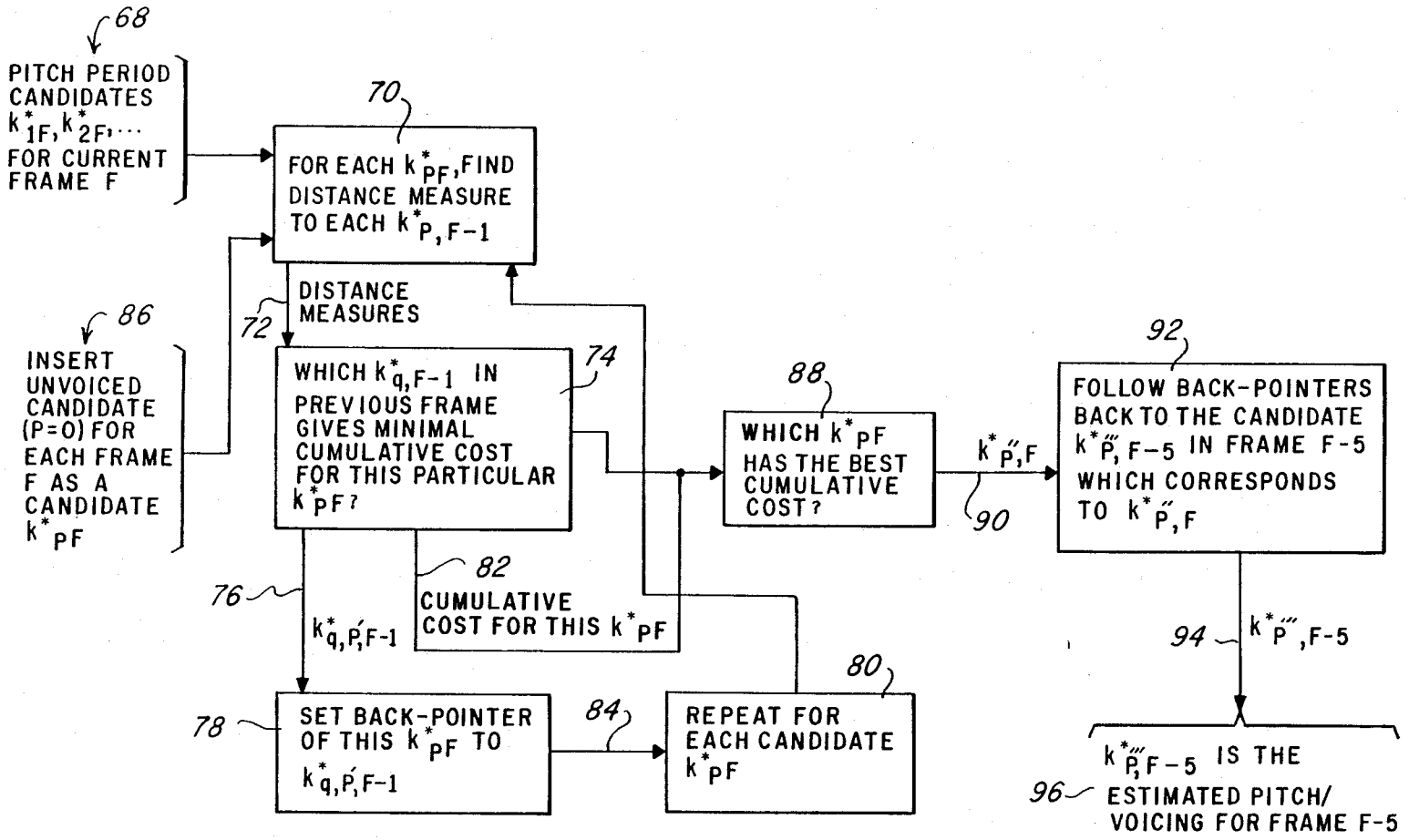
FIG. 3 shows generally the configuration of the portion of the system of the present invention wherein an optimal pitch and voicing decision is made, after a set of pitch period candidates has previously been identified.
Figure 4A:
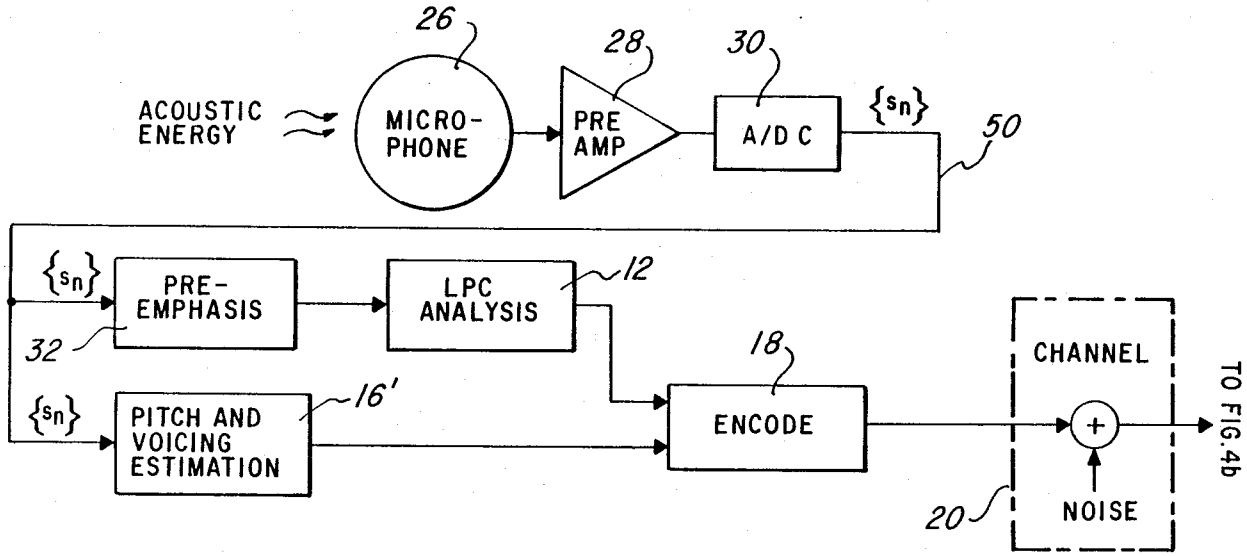
FIGS. 4*a* and 4*b* show a composite block diagram illustrating generally the configuration using the presently preferred embodiment for pitch tracking.
Figure 4B:
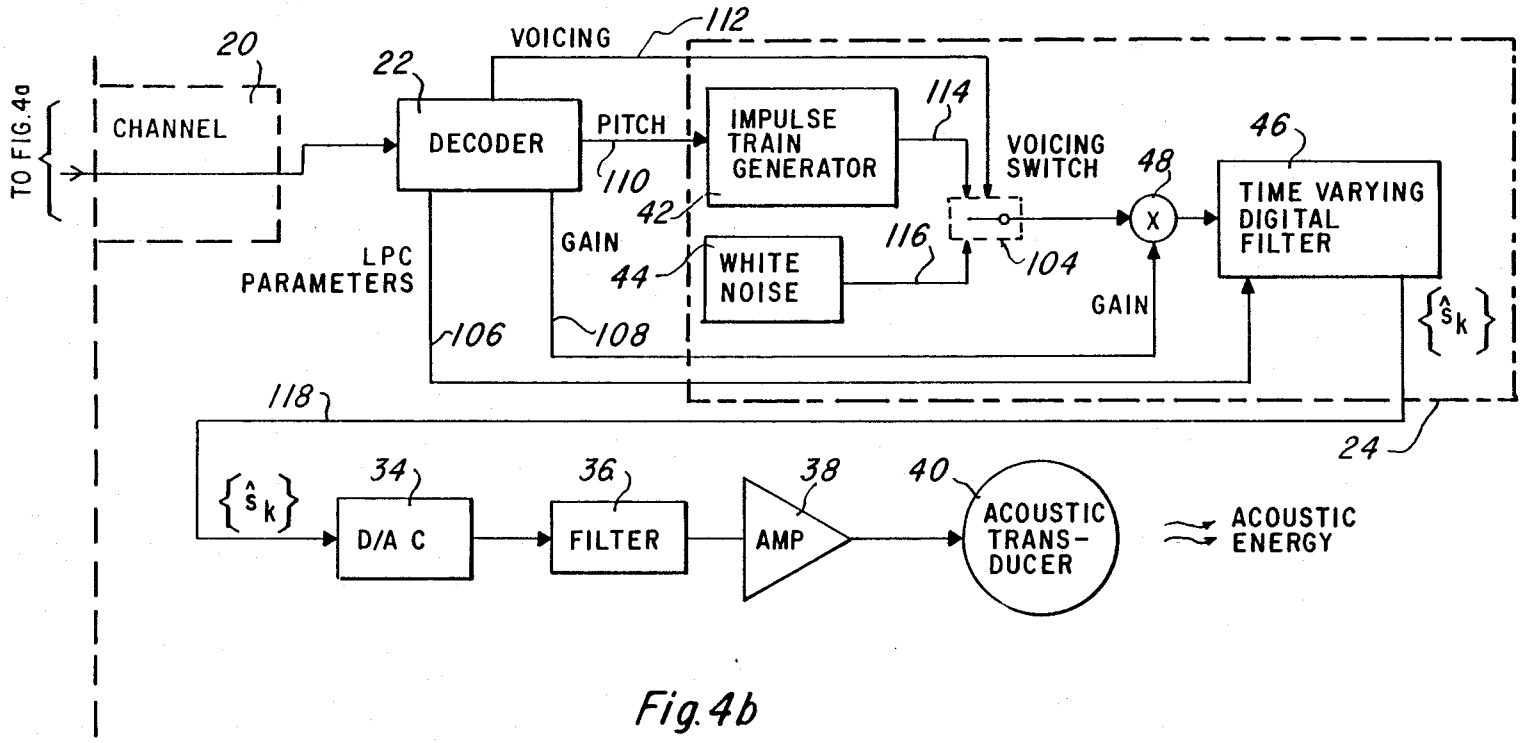

This dynamic programming method for simultaneously finding both pitch and voicing is itself novel, and need not be used only in combination with the presently preferred method of finding pitch period candidates. Any method of finding pitch period candidates can be used in combination with this novel dynamic programming algorithm. Whatever the method used to find pitch period candidates, the candidates are simply provided as input to the dynamic programming algorithm, as shown in FIG. 3.

The present invention is at present preferably embodied on a VAX 11/780, and is specified by the accompanying Fortran code in the appendix, which is hereby incorporated by reference. However, the present invention can be embodied on a wide variety of other systems.

In particular, while the embodiment of the present invention using a minicomputer and high-precision sampling is presently preferred, this system is not economical for large-volume applications. Thus, the preferred mode of practicing the invention in the future is expected to be in embodiment using a microcomputer based system, such as the TI Professional Computer. This professional computer, when configured with a microphone, loudspeaker, and speech processing board including a TMS 320 numerical processing microprocessor and data converters, is sufficient hardware to practice the present invention. The code for practicing the present invention in this embodiment is also provided in the appendix. (This code is written in assembly language for the TMS 320, with extensive documentation.) System documentation for this system is also included in the appendix. All of the appendices are hereby incorporated by reference.

That is, the invention as presently practiced uses a VAX with high-precision data conversion (D/A and A/D), half-gigabyte hard-disk drives and a 9600 band modem. By contrast, a microcomputer-based system embodying the present invention is preferably configured much more economically. For example, a computer system based upon the 8088 microprocessor (such as the TI Professional Computer) could be used together with lower-precision (e.g., 12-bit) data conversion chips, floppy or small Winchester disk drives, and a 300 or 1200-band modem (on codec). Using the coding parameters given above, a 9600 band channel gives approximately real-time speech transmission rates, but of course the transmission rate is nearly irrelevant for voice mail applications, since buffering and storage is necessary anyway.

In general, the present invention can be widely modified and varied, and is therefore not limited except as specified in the accompanying claims.

What is claimed is:

1. A voice messaging system for encoding and regenerating human speech comprising:

LPC analysis means for analyzing an analog speech signal provided as an input thereto in accordance with an LPC (Linear Predictive Coding) model, said LPC analysis means providing LPC parameters and a residual signal as an output representative of the analog speech signal;

adaptive filter means operably coupled to the output of said LPC analysis means for receiving said residual signal and at least one LPC parameter from said LPC analysis means, said adaptive filter means filtering said residual signal in accordance with a time-varying filter characteristic defined by said at least one LPC parameter, wherein the time-varying filter characteristic provides for the removal of high frequency noise from the residual signal during periods of voiced speech and for the retention of high frequency energy in the residual signal during periods of unvoiced speech, to provide an adaptively filtered residual signal as an output therefrom;

means operably connected to the output of said adaptive filter means for extracting pitch and voicing information from said adaptively filtered residual signal; and means operably connected to the outputs of said extracting means and said LPC analysis means for encoding said pitch and voicing information and said LPC parameters.

2. A system as set forth in claim 1, further including:

decoding means operably associated with said encoding means for decoding said pitch and voicing information and said LPC parameters;

excitation means connected to receive said pitch and voicing information from said decoding means for providing an excitation function in accordance with said pitch and voicing information; and time-varying filtering means for filtering said excitation function in accordance with said LPC parameters.

3. A system as set forth in claim 1, wherein the time-varying filter characteristic of said adaptive filter means is defined by the first reflection coefficient as said at least one LPC parameter provided by said LPC analysis means.

4. A system as set forth in claim 1, wherein said extracting means for extracting pitch and voicing information from said adaptively filtered residual signal comprises means for determining normalized correlation values of said adaptively filtered residual signal.

5. A method for determining the pitch of human speech comprising the steps of:

analyzing a speech signal input in accordance with an LPC (Linear Predictive Coding) model to provide LPC parameters and a residual signal;

adaptively filtering said residual signal in accordance with a time-varying filtering characteristic as defined by at least one of said LPC parameters provided by the analyzing of said speech signal input, wherein the time-varying filtering characteristic provides for the removal of high frequency noise from the residual signal during periods of voiced speech and for the retention of higher frequency energy in the residual signal during periods of unvoiced speech, to provide an adaptively filtered residual signal; and extracting pitch period candidates from said adaptively filtered residual signal.

6. A method as set forth in claim 5, wherein the adaptive filtering of said residual signal is accomplished by employing a time-varying filtering characteristic defined by the first reflection coefficient corresponding to said at least one of said LPC parameters as provided by the analysing of said speech signal input.

7. A method as set forth in claim 5, wherein the extracting of pitch period candidates from said adaptively filtered residual signal comprises extracting normalized correlation values of said adaptively filtered residual signal.

8. A method as set forth in claim 5, wherein the adaptive filtering of said residual signal is accomplished by a single-pole filter.

9. A method as seth forth in claim 5, wherein said LPC parameters as provided by the analyzing of said speech signal input are reflection coefficients.

10. A method as set forth in claim 6, wherein said LPC parameters as provided by the analyzing of said speech signal input are reflection coefficients.

11. A method as set forth in claim 5, wherein said LPC parameters are provided by the analyzing of said speech signal input by calculating said LPC parameters in a sequence of frames at a predetermined frame rate, and wherein said speech signal input is received for analysis at a sample rate much higher than said predetermined frame rate.

12. A method as set forth in claim 11, wherein the extracting of pitch period candidates from said adaptively filtered residual signal is accomplished such that said pitch period candidates are extracted at said frame rate.

13. A method as set forth in claim 5, further including:

extracting an optimal pitch period candidate from among said pitch period candidates.

14. A method as set forth in claim 13, wherein the extracting of an optimal pitch period candidate is accomplished via dynamic programming for finding a pitch period which is optimal in the context of pitch period candidates in adjacent frames.

15. A method as set forth in claim 13, further including:

performing dynamic programming with respect both to said pitch period candidates for each frame and also to a voiced/unvoiced decision for each frame to determine both an optimal pitch period and an optimal voicing decision for each frame in the context of said sequence of frames; and determining an optimal pitch and voicing decision for each said frame in accordance with said dynamic programming performance.

16. A method for determining the pitch of human speech, comprising the steps of:

receiving an input speech signal at a sample rate;

analyzing said input speech signal according to an LPC (Linear Predictive Coding) model to provide LPC parameters and a residual signal, wherein said LPC parameters are calculated in a sequence of frames at a predetermined frame rate, and wherein the sample rate at which said input speech signal is received is much higher than said frame rate;

adaptively filtering said residual signal by a filter having a time-varying filtering characteristic defined by at least one of said LPC parameters provided by said LPC analyzing step, wherein the time-varying filtering characteristic provides for the removal of high frequency noise from the residual signal during periods of voiced speech and for the retention of high frequency energy in the residual signal during periods of unvoiced speech, to provide an adaptively filtered residual signal;

extracting pitch period candidates from said adaptively filtered residual signal;

performing dynamic programming with respect both to said pitch period candidates for each frame and also to a voiced/unvoiced decision for each frame to determine both an optimal pitch period and an optimal voicing decision for each frame, in the context of said sequence of frames, said dynamic programming step defining a transition error between each period candidate of the current frame and each candidate of the preceding frame and wherein a cumulative error is defined for each pitch period candidate in the current frame which is equal to the transition error between said pitch period candidate of said current frame plus the cumulative error at an optimally identified pitch period candidate in the preceding frame chosen from among said pitch period candidates in said preceding frame such that the cumulative error of said corresponding pitch period candidate in said current frame is at a minimum; and determining an optimal pitch and voicing decision for each said frame in accordance with said dynamic programming performance.

17. The method of claim 16, wherein said transition error includes a pitch deviation error, said pitch deviation error corresponding to the difference in pitch between said pitch period candidate in said current frame and said corresponding pitch period candidate in said previous frame if both said frames are voiced.

18. The method of claim 17, wherein said pitch deviation error is set at a constant if at least one of said frames is unvoiced.

19. The method of claim 16, wherein said transition error also includes a voicing transition error component, said voicing transistion error component being defined to be a small predetermined value when said current frame and said previous frame are both identically voiced or both identically unvoiced, and otherwise being defined to be a decreasing function of the spectral difference between said current frame and said previous frame.

20. The method of claim 16, wherein said transition error further comprises a voicing state error, said voicing state error corresponding to the degree to which said speech signal within said current frame is correlated at the period of said pitch period candidate.

* * * * *